US010642185B2

(12) United States Patent
Shimadu et al.

(10) Patent No.: US 10,642,185 B2
(45) Date of Patent: May 5, 2020

(54) SCANNING EXPOSURE DEVICE, MANUFACTURING METHOD OF SCANNING EXPOSURE DEVICE AND CONTROL METHOD OF SCANNING EXPOSURE DEVICE

(71) Applicant: BROTHER KOGYO KABUSHIKI KAISHA, Nagoya-shi, Aichi-ken (JP)

(72) Inventors: Michihiro Shimadu, Toyota (JP); Shunsuke Hachiya, Nagoya (JP); Yoshifumi Nakamura, Suzuka (JP)

(73) Assignee: BROTHER KOGYO KABUSHIKI KAISHA, Nagoya-Shi, Aichi-ken (JP)

( * ) Notice: Subject to any disclaimer, the term of this patent is extended or adjusted under 35 U.S.C. 154(b) by 0 days.

(21) Appl. No.: 16/270,873

(22) Filed: Feb. 8, 2019

(65) Prior Publication Data

US 2019/0243276 A1 Aug. 8, 2019

(30) Foreign Application Priority Data

Feb. 8, 2018 (JP) ..... 2018-020908

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC . G03G 15/04; G03G 15/043; G03G 15/04036
See application file for complete search history.

(56) References Cited

U.S. PATENT DOCUMENTS

2004/0037584 A1 2/2004 Takahashi et al.
2007/0242315 A1 10/2007 Sobue
2016/0282749 A1* 9/2016 Yokoi ..... G03G 15/043

FOREIGN PATENT DOCUMENTS

JP 2003-322810 A 11/2003
JP 2007-286129 A 11/2007
JP 2011-148142 A 8/2011
JP 2011-22499 A 11/2011
JP 2014-038165 A 2/2014

* cited by examiner

*Primary Examiner* — Thomas S Giampaolo, II
(74) *Attorney, Agent, or Firm* — Merchant & Gould P.C.

(57) ABSTRACT

A scanning exposure device including: a first and a second light sources emitting a first and second beam, respectively; a polygon mirror having reflecting surfaces; a first and a second optical sensors detecting the first and the second beam, respectively; and a controller storing first writing time until which an exposure by the first beam starts after the first beam is detected and second writing time until which an exposure by the second beam starts after the first beam is detected, for respective reference surface identifiers specifying the respective reflecting surfaces, and the controller acquires a first timing at which the first beam is detected and a second timing at which the second beam is detected for the respective reflecting surfaces identified by respective acquisition surface identifiers; and specifies a correspondence relation between the respective reference surface identifiers and the respective acquisition surface identifiers.

13 Claims, 12 Drawing Sheets

FIG. 5A

WRITING TIME DATA

| REFERENCE SURFACE NUMBER | F1 (MIRROR SURFACE 41) | F2 (MIRROR SURFACE 42) | F3 (MIRROR SURFACE 43) | F4 (MIRROR SURFACE 44) | F5 (MIRROR SURFACE 45) | F6 (MIRROR SURFACE 46) |
|---|---|---|---|---|---|---|
| REFERENCE TIME DIFFERENCE x | x1 | x2 | x3 | x4 | x5 | x6 |
| FIRST WRITING TIME TY | TY1 | TY2 | TY3 | TY4 | TY5 | TY6 |
| SECOND WRITING TIME TK | TK1 | TK2 | TK3 | TK4 | TK5 | TK6 |
| THIRD WRITING TIME TM | TM1 | TM2 | TM3 | TM4 | TM5 | TM6 |
| FOURTH WRITING TIME TC | TC1 | TC2 | TC3 | TC4 | TC5 | TC6 |

FIG. 5B

TIMING DATA

| ACQUISITION SURFACE NUMBER | A1 | A2 | A3 | A4 | A5 | A6 |
|---|---|---|---|---|---|---|
| FIRST TIMING T1 | T11 | T12 | T13 | T14 | T15 | T16 |
| SECOND TIMING T2 | T21 | T22 | T23 | T24 | T25 | T26 |

FIG. 5C

ACQUISITION TIME DIFFERENCE DATA

| ACQUISITION SURFACE NUMBER | A1 | A2 | A3 | A4 | A5 | A6 |
|---|---|---|---|---|---|---|
| ACQUISITION TIME DIFFERENCE y | y1 (T11−T21) | y2 (T12−T22) | y3 (T13−T23) | y4 (T14−T24) | y5 (T15−T25) | y6 (T16−T26) |

FIG. 5D

SURFACE SPECIFYING DATA

| ACQUISITION SURFACE NUMBER | A1 | A2 | A3 | A4 | A5 | A6 |
|---|---|---|---|---|---|---|
| REFERENCE SURFACE NUMBER | F6 (MIRROR SURFACE 46) | F1 (MIRROR SURFACE 41) | F2 (MIRROR SURFACE 42) | F3 (MIRROR SURFACE 43) | F4 (MIRROR SURFACE 44) | F5 (MIRROR SURFACE 45) |

FIG. 7A

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A1 | A2 | A3 | A4 | A5 | A6 | |
| ACQUISITION TIME DIFFERENCE y | y1<br>328.4541 | y2<br>328.4567 | y3<br>328.4585 | y4<br>328.4541 | y5<br>328.4577 | y6<br>328.4581 | r1<br>−0.36644 |

FIG. 7B

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A6 | A1 | A2 | A3 | A4 | A5 | |
| ACQUISITION TIME DIFFERENCE y | y6<br>328.4581 | y1<br>328.4541 | y2<br>328.4567 | y3<br>328.4585 | y4<br>328.4541 | y5<br>328.4577 | r2<br>−0.52092 |

FIG. 7C

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A5 | A6 | A1 | A2 | A3 | A4 | |
| ACQUISITION TIME DIFFERENCE y | y5<br>328.4577 | y6<br>328.4581 | y1<br>328.4541 | y2<br>328.4567 | y3<br>328.4585 | y4<br>328.4541 | r3<br>0.88524 |

FIG. 7D

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A4 | A5 | A6 | A1 | A2 | A3 | |
| ACQUISITION TIME DIFFERENCE y | y4<br>328.4541 | y5<br>328.4577 | y6<br>328.4581 | y1<br>328.4541 | y2<br>328.4567 | y3<br>328.4585 | r4<br>−0.38231 |

FIG. 7E

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A3 | A4 | A5 | A6 | A1 | A2 | |
| ACQUISITION TIME DIFFERENCE y | y3<br>328.4585 | y4<br>328.4541 | y5<br>328.4577 | y6<br>328.4581 | y1<br>328.4541 | y2<br>328.4567 | r5<br>−0.58546 |

FIG. 7F

| REFERENCE SURFACE NUMBER | F1 | F2 | F3 | F4 | F5 | F6 | CORRELATION COEFFICIENT r |
|---|---|---|---|---|---|---|---|
| REFERENCE TIME DIFFERENCE x | x1<br>328.4421 | x2<br>328.4442 | x3<br>328.4402 | x4<br>328.4439 | x5<br>328.4447 | x6<br>328.4407 | — |
| ACQUISITION SURFACE NUMBER | A2 | A3 | A4 | A5 | A6 | A1 | |
| ACQUISITION TIME DIFFERENCE y | y2<br>328.4567 | y3<br>328.4585 | y4<br>328.4541 | y5<br>328.4577 | y6<br>328.4581 | y1<br>328.4541 | r6<br>0.96989 |

FIG. 10

| REFERENCE SURFACE NUMBER | | F1 | F2 | F3 | F4 | F5 | F6 |
|---|---|---|---|---|---|---|---|
| REFERENCE TIME DIFFERENCE x | | x1 | x2 | x3 | x4 | x5 | x6 |
| FIRST WRITING TIME TY | FOR BEAM BY1 | TY11 | TY21 | TY31 | TY41 | TY51 | TY61 |
| | FOR BEAM BY2 | TY12 | TY22 | TY32 | TY42 | TY52 | TY62 |
| SECOND WRITING TIME TK | FOR BEAM BK1 | TK11 | TK21 | TK31 | TK41 | TK51 | TK61 |
| | FOR BEAM BK2 | TK12 | TK22 | TK32 | TK42 | TK52 | TK62 |
| THIRD WRITING TIME TM | FOR BEAM BM1 | TM11 | TM21 | TM31 | TM41 | TM51 | TM61 |
| | FOR BEAM BM2 | TM12 | TM22 | TM32 | TM42 | TM52 | TM62 |
| FOURTH WRITING TIME TC | FOR BEAM BC1 | TC11 | TC21 | TC31 | TC41 | TC51 | TC61 |
| | FOR BEAM BC2 | TC12 | TC22 | TC32 | TC42 | TC52 | TC62 |

SCANNING EXPOSURE DEVICE, MANUFACTURING METHOD OF SCANNING EXPOSURE DEVICE AND CONTROL METHOD OF SCANNING EXPOSURE DEVICE

CROSS-REFERENCE TO RELATED APPLICATIONS

This application claims priority from Japanese Patent Application No. 2018-020908 filed on Feb. 8, 2018, the entire contents of which are incorporated herein by reference.

TECHNICAL FIELD

The present disclosure relates to a scanning exposure device, a manufacturing method of a scanning exposure device and a control method of a scanning exposure device.

In related art, a scanning exposure device including a first laser diode configured to generate a first beam for exposing a first photosensitive member, a second laser diode configured to generate a second beam for exposing a second photosensitive member, a polygon mirror configured to reflect the first beam and the second beam, and one BD sensor configured to receive the first beam reflected by the polygon mirror has been known. In this technology, the exposure is started by the first beam after first writing time from detection of the first beam by the BD sensor, and the exposure is started by the second beam after second writing time from the detection of the first beam by the BD sensor.

According to the above technology, a detection interval of the first beam for each surface of the polygon mirror is measured by the BD sensor configured to detect the first beam, and the second writing time is generated on the basis of a result of the measurement. For this reason, in a case where an error occurs in the detection of the BD sensor, the second writing time to be generated may be varied. When the second writing time is varied, the accuracy of a writing position of the second beam on the second photosensitive member is lowered, so that it is not possible to perform the high-accuracy exposure.

SUMMARY

The present disclosure has been made in view of the above situations, and an object thereof is to provide a scanning exposure device, a manufacturing method of a scanning exposure device and a control method of a scanning exposure device capable of performing high-accuracy exposure.

According to an illustrative embodiment of the present disclosure, there is provided a scanning exposure device including: a first light source configured to emit a first beam; a second light source configured to emit a second beam; a polygon mirror having N reflecting surfaces for reflecting the first beam and the second beam; a first scanning optical system configured to focus the first beam, which is reflected by the polygon mirror, on a first image surface; a second scanning optical system configured to focus the second beam, which is reflected by the polygon mirror, on a second image surface; a first optical sensor configured to detect the first beam reflected by the polygon mirror; a second optical sensor configured to detect the second beam reflected by the polygon mirror; and a controller storing reference surface identifiers that respectively specify the reflecting surfaces of the polygon mirror and storing first writing time, which is time until which the first image surface is started to be exposed by the first beam after the first beam is detected by the first optical sensor, and second writing time, which is time until which the second image surface is started to be exposed by the second beam after the first beam is detected by the first optical sensor, for each of the reference surface identifiers, and the controller is configured to: acquire a first timing at which the first optical sensor detects the first beam and a second timing at which the second optical sensor detects the second beam for each of the reflecting surfaces when the polygon mirror is rotated at a constant speed and the first beam and the second beam are reflected by each of the reflecting surfaces, the respective reflecting surfaces being identified by respective acquisition surface identifiers; and specify a correspondence relation between the respective reference surface identifiers and the respective acquisition surface identifiers based on the first timing and the second timing.

According to an illustrative embodiment of the present disclosure, there is provided a manufacturing method of a scanning exposure device, the scanning exposure device including: a first light source configured to emit a first beam; a second light source configured to emit a second beam; a polygon mirror having N reflecting surfaces for reflecting the first beam and the second beam; a first scanning optical system configured to focus the first beam, which is reflected by the polygon mirror, on a first image surface; a second scanning optical system configured to focus the second beam, which is reflected by the polygon mirror, on a second image surface; a first optical sensor configured to detect the first beam reflected by the polygon mirror; a second optical sensor configured to detect the second beam reflected by the polygon mirror; and a controller having a storage which stores reference surface identifiers that respectively specify the reflecting surfaces of the polygon mirror, stores first writing time, which is time until which the first image surface is started to be exposed by the first beam after the first beam is detected by the first optical sensor, and second writing time, which is time until which the second image surface is started to be exposed by the second beam after the first beam is detected by the first optical sensor, for each of the reference surface identifiers, and stores a reference time difference between a timing at which the first optical sensor detects the first beam and a timing at which the second optical sensor detects the second beam for each of the reference surface identifiers, and the controller is configured to: acquire a first timing at which the first optical sensor detects the first beam and a second timing at which the second optical sensor detects the second beam for each of the reflecting surfaces when the polygon mirror is rotated at a constant speed and the first beam and the second beam are reflected by each of the reflecting surfaces of the polygon mirror, the respective reflecting surfaces being identified by respective acquisition surface identifiers; and specify a correspondence relation between the respective reference surface identifiers and the respective acquisition surface identifiers based on the reference time difference, the first timing and the second timing, and the manufacturing method includes: determining the first writing time and the second writing time for each of the reference surface identifiers and storing the first writing time and the second writing time in the storage; and storing the reference time difference for each of the reference surface identifiers in the storage.

According to an illustrative embodiment of the present disclosure, there is provided a control method of a scanning exposure device, the scanning exposure device including: a first light source configured to emit a first beam; a second light source configured to emit a second beam; a polygon mirror having N reflecting surfaces for reflecting the first beam and the second beam; a first scanning optical system configured to focus the first beam, which is reflected by the polygon mirror, on a first image surface; a second scanning optical system configured to focus the second beam, which is reflected by the polygon mirror, on a second image surface; a first optical sensor configured to detect the first beam reflected by the polygon mirror; a second optical sensor configured to detect the second beam reflected by the polygon mirror; and a storage in which first writing time, which is time until which the first image surface is started to be exposed by the first beam after the first beam is detected by the first optical sensor, and second writing time, which is time until which the second image surface is started to be exposed by the second beam after the first beam is detected by the first optical sensor, are stored for each of the reflecting surfaces of the polygon mirror, and the control method including: acquiring a first timing, at which the first optical sensor detects the first beam, and a second timing, at which the second optical sensor detects the second beam, when the polygon mirror is rotated at a constant speed and the first beam and the second beam are reflected by each of the reflecting surfaces of the polygon mirror; and specifying each of the reflecting surfaces corresponding to the first writing time and the second writing time, based on the first timing and the second timing.

BRIEF DESCRIPTION OF DRAWINGS

FIG. 5A depicts writing time data, FIG. 5B depicts timing data, FIG. 5C depicts acquisition time difference data and FIG. 5D depicts surface specifying data;

FIGS. 7A to 7F depict correspondence patterns;

FIG. 10 depicts writing time data of a modified embodiment.

DETAILED DESCRIPTION

Hereinafter, an illustrative embodiment of the present disclosure will be described in detail with reference to the drawings.

Figure 1:
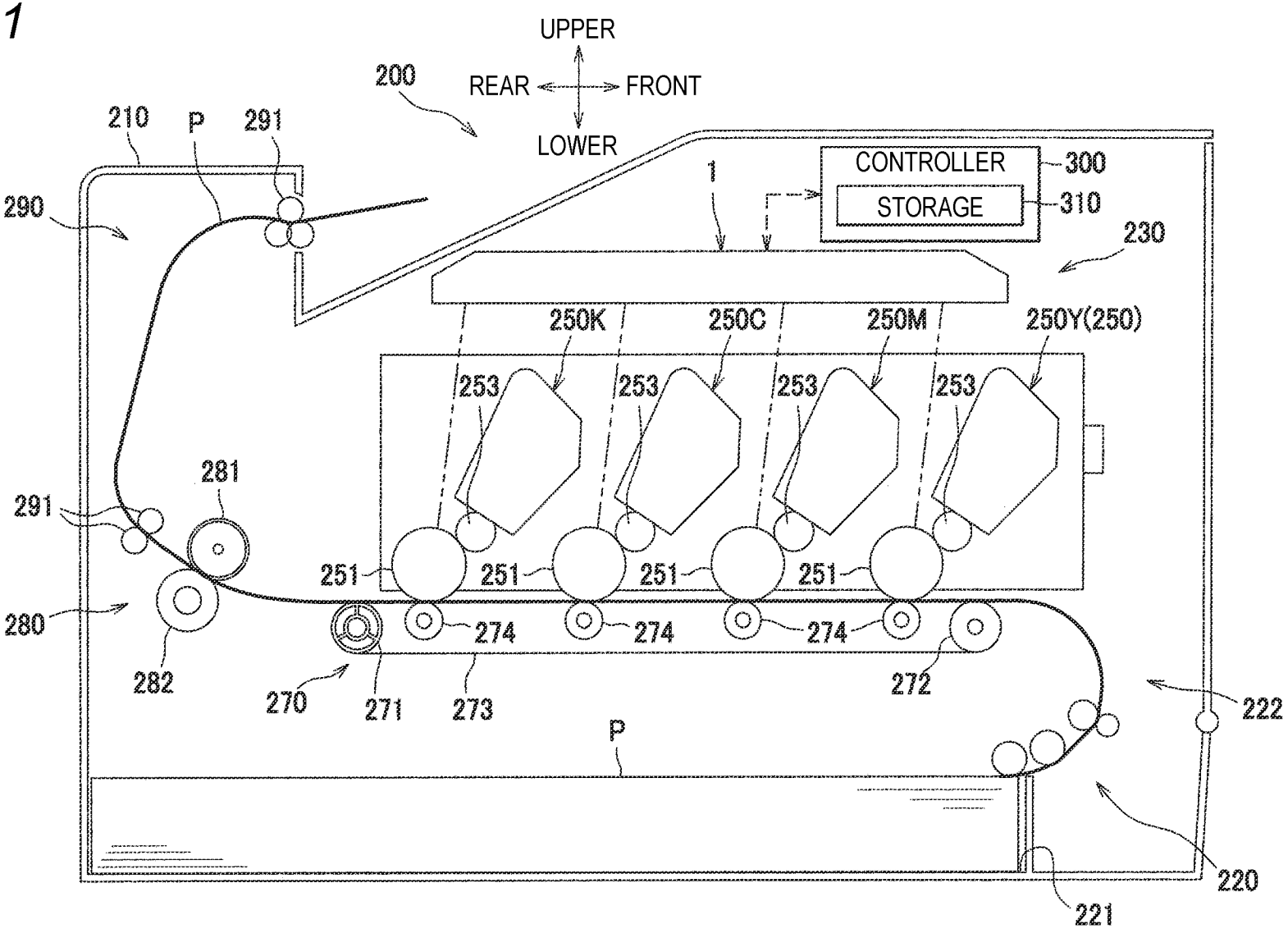
FIG. 1 depicts a schematic configuration of an image forming apparatus including a scanning exposure device in accordance with an illustrative embodiment.

As shown in FIG. 1, a color printer 200, which is an image forming apparatus, includes, in a main body housing 210, a sheet feeding unit 220, an image forming unit 230, a sheet discharge unit 290, and a controller 300.

The sheet feeding unit 220 includes an accommodation tray 221 in which sheets P are accommodated, and a feeding mechanism 222 configured to feed the sheet P from the accommodation tray 221 to the image forming unit 230.

The image forming unit 230 includes a scanning exposure device 1, four process cartridges 250, a transfer unit 270, and a fixing device 280.

The scanning exposure device 1 is a device configured to expose surfaces of a plurality of photosensitive members 251, and is provided at an upper part in the main body housing 210. In the meantime, the scanning exposure device 1 and the controller 300 configured to control the scanning exposure device 1 will be described in detail later.

The process cartridges 250 are aligned in a front and rear direction above the sheet feeding unit 220, and each of the process cartridges 250 includes a photosensitive member 251, which is a cylindrical photosensitive drum, a well-known charger (not shown), a developing roller 253, a developing agent accommodation chamber and the like. In the respective process cartridges 250, developing agents made of black, cyan, magenta and yellow dry toners are accommodated. In the meantime, in the specification and the drawings, when specifying the respective photosensitive members 251 and the like, black, cyan, magenta and yellow are denoted by the symbols of K, C, M and Y, respectively.

The transfer unit 270 is provided between the sheet feeding unit 220 and the four process cartridges 250, and includes a drive roller 271, a driven roller 272, a conveyor belt 273 and transfer rollers 274.

The drive roller 271 and the driven roller 272 are disposed in parallel with each other with being spaced in the front and rear direction, and the conveyor belt 273, which is an endless belt, is stretched therebetween. Also, the four respective transfer rollers 274 are disposed to face the respective photosensitive members 251 at an inner side of the conveyor belt 273, and the conveyor belt 273 is sandwiched between the respective transfer rollers 274 and the respective photosensitive members 251.

The fixing device 280 is disposed at the rear of the four process cartridges 250 and the transfer unit 270, and includes a heating roller 281 and a pressing roller 282 disposed to face the heating roller 281 and configured to press the heating roller 281.

In the image forming unit 230 configured as described above, a surface of each photosensitive member 251 is uniformly charged by the charger and is then exposed by the scanning exposure device 1. Thereby, an electrostatic latent image based on image data is formed on each photosensitive member 251. Thereafter, the developing agent in the developing agent accommodation chamber is supplied to the electrostatic latent image on the photosensitive member 251 by the developing roller 253, so that a developing agent image is carried on the photosensitive member 251.

Then, the sheet P supplied onto the conveyor belt 273 passes between each photosensitive member 251 and each transfer roller 274, so that the developing agent image formed on each photosensitive member 251 is transferred onto the sheet P. Then, the developing agent images transferred onto the sheet P are heat-fixed by the fixing device 280, so that an image is formed on the sheet P.

The sheet discharge unit 290 mainly has a plurality of conveyor rollers 291 configured to convey the sheet P. The sheet P having the image formed thereon is conveyed by the conveyor rollers 291 and is discharged to an outside of the main body housing 210.

Subsequently, a configuration of the scanning exposure device 1 is described in detail. Meanwhile, in below descriptions, "main scanning direction" indicates a direction in which a beam is to be scanned, and corresponds to a rotation axis direction of the photosensitive member 251, in the illustrative embodiment. Also, "sub-scanning direction"

indicates a direction perpendicular to the main scanning direction on a surface of the photosensitive member 251, which is an image surface.

Figure 2:
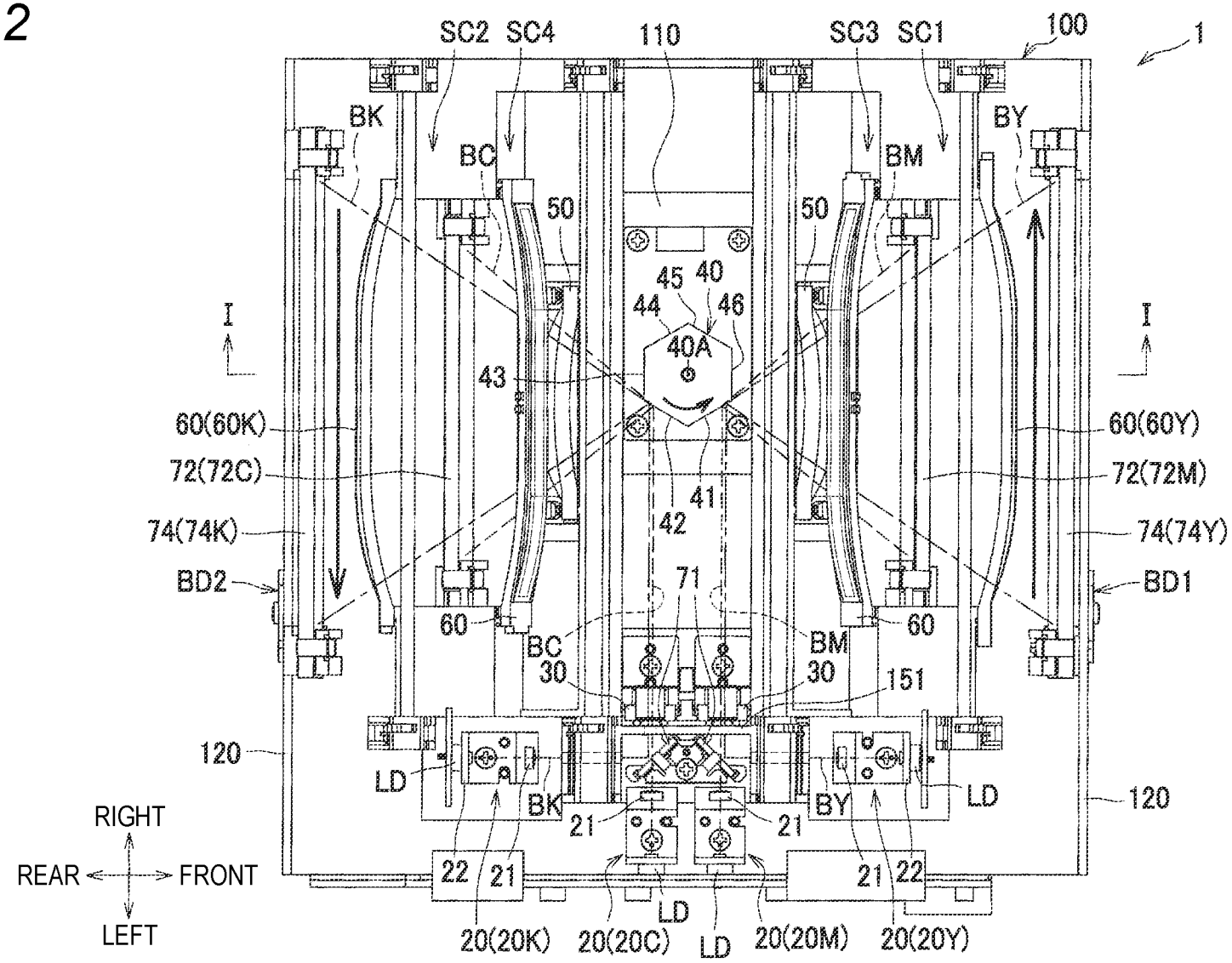
FIG. 2 is a plan view of the scanning exposure device.
Figure 3:
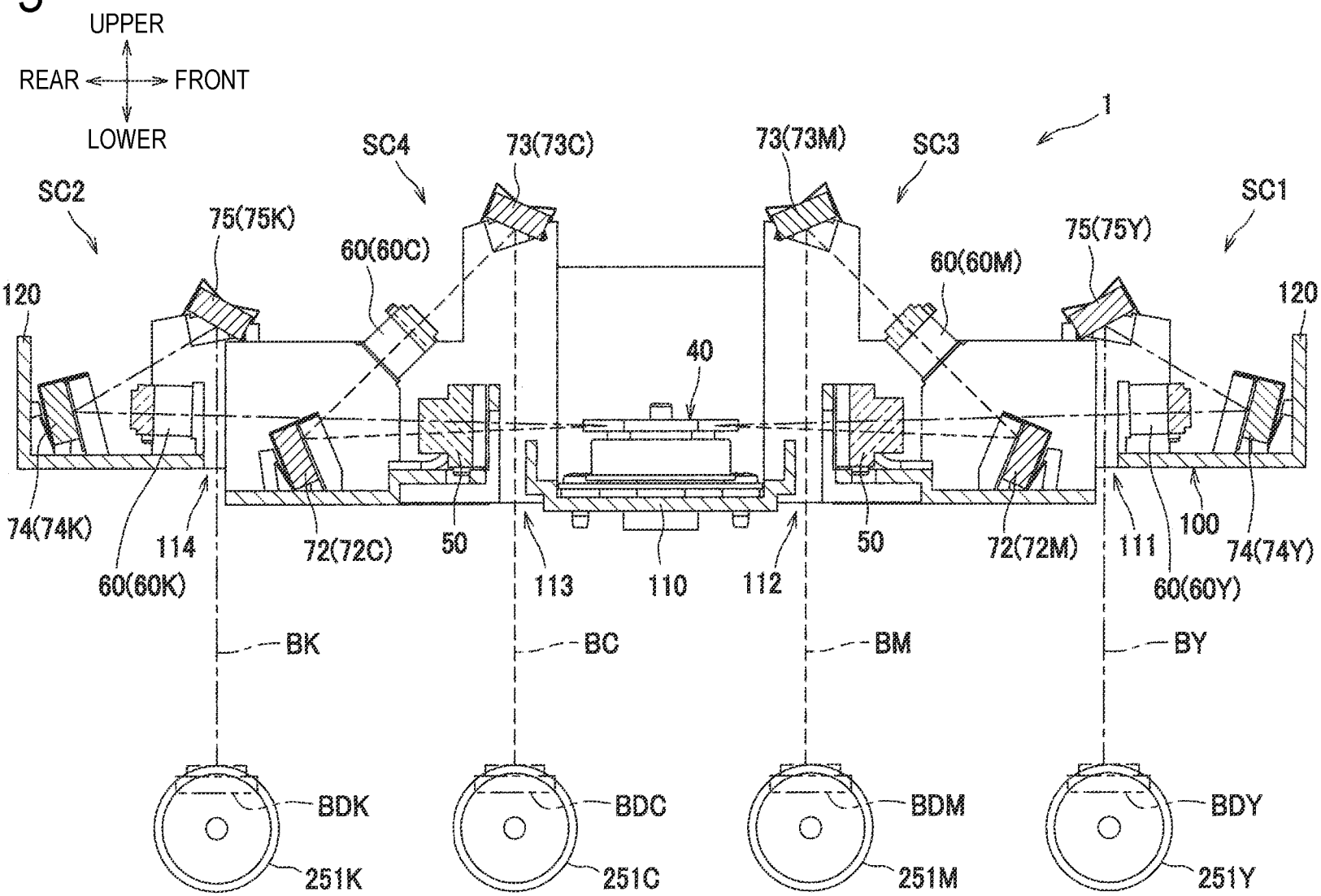
FIG. 3 is a sectional view taken along a line I-I of FIG. 2.

As shown in FIGS. 2 and 3, the scanning exposure device 1 includes one casing 100, four light source devices 20 (20Y, 20M, 20C, 20K), two reflectors 71, two first cylindrical lenses 30, one polygon mirror 40, one first scanning optical system SC1, one second scanning optical system SC2, one third scanning optical system SC3 and one fourth scanning optical system SC4.

The light source devices 20Y, 20M, 20C, 20K are devices configured to emit beams BY, BM, BC, BK, respectively, and the four respective light source devices are provided in correspondence to the four respective photosensitive members 251Y, 251M, 251C, 251K that are to be scanned and exposed by the scanning exposure device 1. The light source device 20M and the light source device 20C are disposed side by side in the front and rear direction, and are configured to emit the beams BM, BC in a right and left direction. The light source device 20Y and the light source device 20K are disposed with facing each other in the front and rear direction so that the beams BY, BK to be emitted therefrom are to be substantially perpendicular to the beams BM, BC to be emitted from the light source devices 20M, 20C. In the illustrative embodiment, the light source device 20Y corresponds to "first light source", the light source device 20K corresponds to "second light source", and the light source device 20M corresponds to "third light source". Also, the light source device 20C can be referred to as a fourth light source.

The light source devices 20Y to 20K mainly include a semiconductor laser LD, a coupling lens 21 and a frame 22, respectively. The coupling lens 21 is a lens configured to convert a laser light emitted with being scattered from the semiconductor laser LD into a light beam. In the meantime, the light beam converted by the coupling lens 21 may be any of parallel light, converging light and diverging light. In below descriptions, the beam BY that is to be emitted from the light source device 20Y is referred to as 'first beam BY', and the beam BK that is to be emitted from the light source device 20K is referred to as 'second beam BK'. Also, the beam BM that is to be emitted from the light source device 20M is referred to as 'third beam BM', and the beam BC that is to be emitted from the light source device 20C is referred to as 'fourth beam BC'.

The reflector 71 is a member configured to reflect the beam BY from the light source device 20Y or the beam BK from the light source device 20K toward the polygon mirror 40, and is disposed between the light source devices 20M, 20C and the polygon mirror 40. In the meantime, the beam BM from the light source device 20M and the beam BC from the light source device 20C are respectively incident on the polygon mirror 40 through the above of the reflector 71.

The first cylindrical lens 30 is a lens configured to refract and converge the beams BY, BM, BC, BK in the sub-scanning direction and to focus the beams in a line shape, which is long in the main scanning direction, on the mirror surfaces 41 to 46 of the polygon mirror 40, so as to correct surface tilting of the polygon mirror 40. The first cylindrical lens 30 is disposed between the reflector 71 and the polygon mirror 40.

In the meantime, a wall 151 of the casing 100 provided between the reflector 71 and the first cylindrical lens 30 is formed with a plurality of openings (refer to the broken line), and the openings of the wall 151 define widths of the beams BY, BM, BC, BK to pass therethrough in the main scanning direction and the sub-scanning direction.

The polygon mirror 40 has N reflecting surfaces, i.e., six mirror surfaces 41 to 46 equidistantly spaced from a rotation axis 40A. The respective mirror surfaces 41 to 46 rotate at a constant speed about the rotation axis 40A, so that the polygon mirror 40 reflects the beams BY, BM, BC, BK having passed through the first cylindrical lens 30 and deflects the same in the main scanning direction. Specifically, the polygon mirror 40 is configured to reflect the first beam BY emitted from the light source device 20Y toward the first scanning optical system SC1, and to reflect the second beam BK emitted from the light source device 20K toward the second scanning optical system SC2. Also, the polygon mirror 40 is configured to reflect the third beam BM emitted from the light source device 20M toward the third scanning optical system SC3, and to reflect the fourth beam BC emitted from the light source device 20C toward the fourth scanning optical system SC4. The polygon mirror 40 is arranged to face the light source devices 20M, 20C in the right and left direction at a substantial center of the casing 100.

The first scanning optical system SC1 is an optical system configured to focus the first beam BY, which is reflected by the polygon mirror 40, on the photosensitive member 251Y, and includes one fθ lens 50, one second cylindrical lens 60 (60Y), and a plurality of reflectors 74 (74Y), 75 (75Y). The photosensitive member 251Y is an image surface of the first scanning optical system SC1. The second scanning optical system SC2 is an optical system configured to focus the second beam BK, which is reflected by the polygon mirror 40, on the photosensitive member 251K, and includes one fθ lens 50, one second cylindrical lens 60 (60K), and a plurality of reflectors 74 (74K), 75 (75K). The photosensitive member 251K is an image surface of the second scanning optical system SC2.

The third scanning optical system SC3 is an optical system configured to focus the third beam BM, which is reflected by the polygon mirror 40, on the photosensitive member 251M, and includes one fθ lens 50, one second cylindrical lens 60 (60M), and a plurality of reflectors 72 (72M), 73 (73M). The photosensitive member 251M is an image surface of the third scanning optical system SC3. The fourth scanning optical system SC4 is an optical system configured to focus the fourth beam BC, which is reflected by the polygon mirror 40, on the photosensitive member 251C, and includes one fθ lens 50, one second cylindrical lens 60 (60C), and a plurality of reflectors 72 (72C), 73 (73C). The photosensitive member 251C is located on an image surface of the fourth scanning optical system SC4.

Here, in below descriptions, the photosensitive member 251Y is referred to as a first photosensitive member 251Y, the photosensitive member 251K is referred to as a second photosensitive member 251K, the photosensitive member 251M is referred to as a third photosensitive member 251M, and the photosensitive member 251C is referred to as a fourth photosensitive member 251C.

The fθ lens 50 is a lens configured to converge the beams BY, BM, BC, BK, which are scanned at uniform angular velocity by the polygon mirror 40, on the surface of the photosensitive members 251 and to convert the same so as to scan the beams at uniform velocity in the main scanning direction on the surfaces of the photosensitive members 251, and is respectively provided at the front and at the rear of the polygon mirror 40. In the meantime, the fθ lens 50 provided at the front of the polygon mirror 40 is a member common to the first scanning optical system SC1 and the third scanning optical system SC3, and the fθ lens 50 provided at the rear of the polygon mirror 40 is a member common to the second scanning optical system SC2 and the fourth scanning optical system SC4.

The second cylindrical lens 60 is a lens configured to refract and converge the beams BY, BM, BC, BK in the sub-scanning direction and to focus the same on the surface of the photosensitive member 251, so as to correct the surface tilting of the polygon mirror 40. The respective second cylindrical lens 60 (60Y to 60K) is provided in correspondence to the respective four light source devices 20Y to 20K. The second cylindrical lenses 60M, 60C are disposed above the fθ lens 50, and the second cylindrical lenses 60Y, 60K are disposed to face a sidewall 120 of the casing 100 between the fθ lens 50 and the sidewall 120.

The reflectors 72 to 75 are members configured to reflect the beams BY, BM, BC, BK, and are formed by vapor depositing a material having high reflectivity such as aluminum on a surface of a glass plate, for example.

The reflector 72 (72M, 72C) is disposed between the fθ lens 50 and the second cylindrical lens 60Y, 60K, and is configured to reflect the beam BM, BC having passed through the fθ lens 50 toward the second cylindrical lens 60M, 60C. Also, the reflector 73 (73M, 73C) is disposed above the fθ lens 50, and is configured to reflect the beam BM, BC having passed through the second cylindrical lens 60M, 60C toward the surface of the photosensitive member 251M, 251C.

The reflector 74 (74Y, 74K) is disposed along the sidewall 120 between the second cylindrical lens 60Y, 60K and the sidewall 120 of the casing 100, and is configured to reflect the beam BY, BK having passed through the second cylindrical lens 60Y, 60K toward the reflector 75. Also, the reflector 75 (75Y, 75K) is disposed above the second cylindrical lens 60Y, 60K, and is configured to reflect the beam BY, BK reflected by the reflector 74 toward the surface of the photosensitive member 251Y, 251K.

The first scanning optical system SC1 and the second scanning optical system SC2 are disposed at opposite sides with the polygon mirror 40 being disposed therebetween, as seen from a direction (hereinafter, referred to as "rotation axis direction") in which the rotation axis 40A of the polygon mirror 40 extends. Specifically, the first scanning optical system SC1 is disposed at the front of the polygon mirror 40, and the second scanning optical system SC2 is disposed at the rear of the polygon mirror 40.

The third scanning optical system SC3 is disposed at the front of the polygon mirror 40, like the first scanning optical system SC1, as seen from the rotation axis direction. Also, the fourth scanning optical system SC4 is disposed at the rear of the polygon mirror 40, like the second scanning optical system SC2, as seen from the rotation axis direction.

The casing 100 is a member configured to accommodate therein the light source devices 20, the polygon mirror 40, the second cylindrical lenses 60 and the reflectors 71 to 75. The casing 100 mainly has a support wall 110 and the sidewalls 120 protruding upward from both end portions of the support wall 110 in the front and rear direction.

The support wall 110 is a lower wall of the casing 100, and is configured to support the light source devices 20, the polygon mirror 40, the fθ lenses 50, the second cylindrical lenses 60Y, 60K, the reflectors 72, 74 and the like. The support wall 110 is formed with four exposure ports 111 to 114 which are aligned side by side in the front and rear direction. The respective beams BY, BM, BC, BK reflected by the reflectors 73, 75 toward the surface of the photosensitive member 251 is configured to pass through the respective four exposure ports 111 to 114.

In the scanning exposure device 1 configured as described above, as shown in FIG. 2, the beams BM, BC emitted from the light source devices 20M, 20C, respectively, pass through the first cylindrical lenses 30, are reflected by the polygon mirror 40 and are deflected in the main scanning direction. Also, the beams BY, BK emitted from the light source devices 20Y, 20K, respectively, are reflected by the reflector 71 toward the polygon mirror 40, pass through the first cylindrical lenses 30, are reflected by the polygon mirror 40 and are deflected in the main scanning direction.

As shown in FIG. 3, the beams BM, BC reflected by the polygon mirror 40 pass through the fθ lens 50, are reflected on the reflector 72, pass through the second cylindrical lens 60, are reflected on the reflector 73, and scan and expose the surfaces of the photosensitive members 251M, 251C. Also, the beams BY, BK reflected by the polygon mirror 40 pass through the fθ lens 50 and the second cylindrical lens 60, are reflected by the reflector 74, are reflected by the reflector 75 and scan and expose the surfaces of the photosensitive members 251Y, 251K.

As shown in FIG. 2, the scanning exposure device 1 further includes a first optical sensor BD1 and a second optical sensor BD2.

Figure 4:
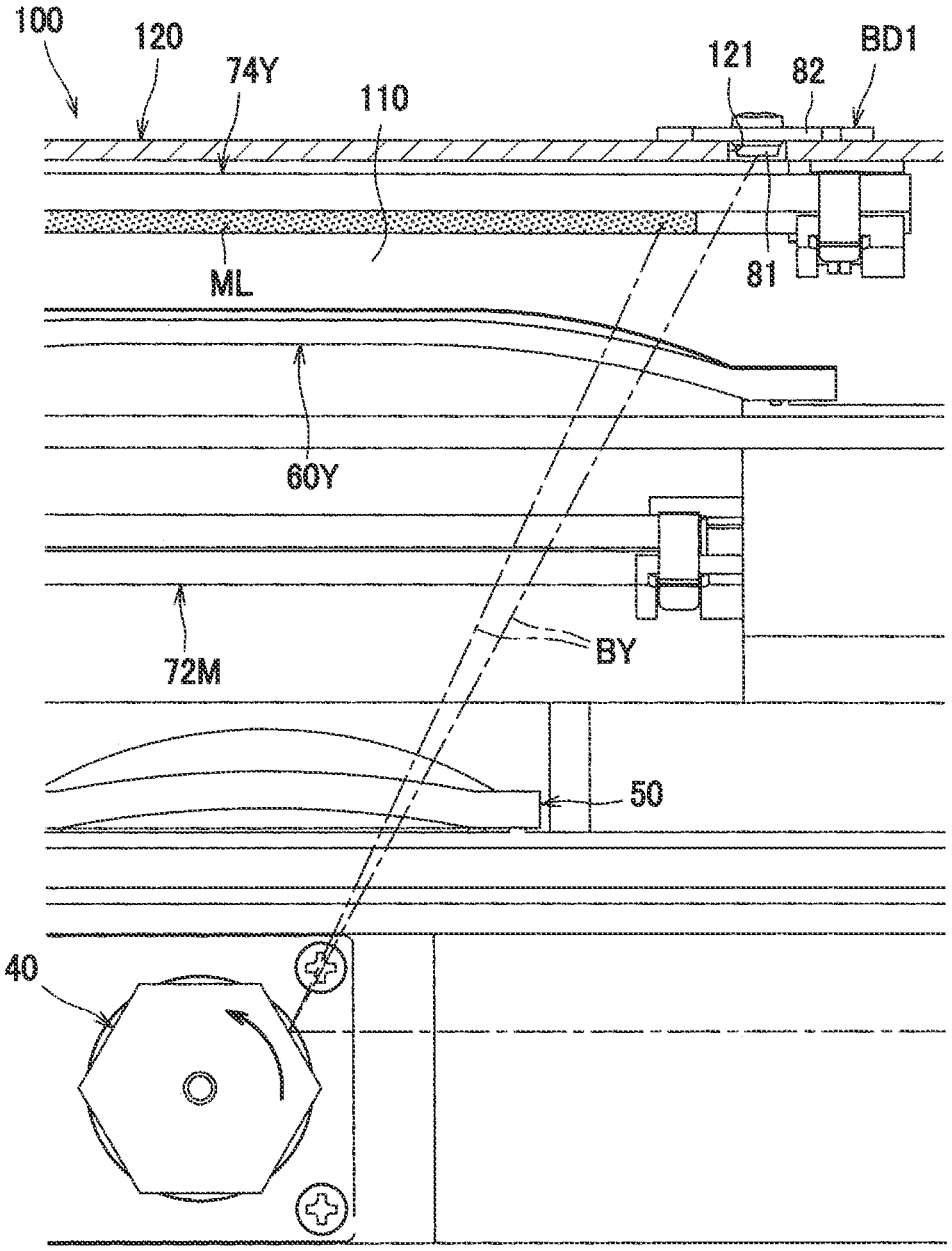
FIG. 4 is an enlarged plan view of the scanning exposure device.

As shown in FIG. 4, the first optical sensor BD1 is a sensor configured to detect the first beam BY reflected by the polygon mirror 40, and mainly includes a light receiving element 81 and a circuit substrate 82 on which the light receiving element 81 is mounted. The first optical sensor BD1 is mounted to the front sidewall 120 from an outside so as to block an opening 121 formed in the front sidewall 120 of the casing 100, so that the light receiving element 81 is disposed with a detection surface facing toward an inside of the casing 100.

The first optical sensor BD1 outputs a signal to the controller 300 when the light receiving element 81 detects the first beam BY. The controller 300 is configured to determine timings at which the respective beams BY, BM, BC, BK for exposure are to be emitted from the respective light source devices 20, based on the signal received from the first optical sensor BD1.

In the meantime, the reflector 74Y is configured so that the first beam BY can penetrate an end portion of the reflector 74Y in a longitudinal direction. Specifically, the reflector 74Y formed by vapor depositing a material having high reflectivity on a surface of a glass plate is not formed with a mirror layer ML (refer to the dots in FIG. 4) at a part corresponding to the first optical sensor BD1. Thereby, the first beam BY can pass through the end portion of the reflector 74Y and can be thus detected by the light receiving element 81. The first optical sensor BD1 is disposed at an upstream side of the mirror layer ML with respect to the scanning direction of the first beam BY. In other words, the first optical sensor BD1 is disposed at a more upstream side with respect to the scanning direction than a range in which the first beam BY is scanned so as to expose the first photosensitive member 251Y.

As shown in FIG. 2, the second optical sensor BD2 is a sensor configured to detect the second beam BK reflected by the polygon mirror 40, and has the same structure as the first optical sensor BD1. Also, the second optical sensor BD2 is mounted to the rear sidewall 120 in the same manner as the first optical sensor BD1. The second optical sensor BD2 outputs a signal to the controller 300 when a light receiving element (not shown) detects the second beam BK.

The second optical sensor BD2 is disposed at a downstream side of the mirror layer ML (not shown) of the reflector 74K with respect to the scanning direction of the second beam BK. In other words, the second optical sensor BD2 is disposed at a more downstream side with respect to the scanning direction than a range in which the second beam BK is scanned so as to expose the second photosensitive member 251K.

In below descriptions, the time at which the first optical sensor BD1 detects the first beam BY is referred to as 'first timing T1', and the time at which the second optical sensor BD2 detects the second beam BK is referred to as 'second timing T2'.

As shown in FIG. 1, the controller 300 is provided in the main body housing 210, and mainly includes a CPU, a storage 310 having a RAM, a ROM and the like, and an input/output circuit. The controller 300 is connected to the scanning exposure device 1, and is configured to control each light source device 20, a motor of the polygon mirror 40 and the like of the scanning exposure device 1, based on the signals from the respective optical sensors BD1, BD2 of the scanning exposure device 1 and a program and data stored in the storage 310.

In the storage 310, respective first writing time TY, second writing time TK, third writing time TM and fourth writing time TC are stored for the respective mirror surfaces 41 to 46 of the polygon mirror 40. Also, in the storage 310, a reference time difference x is stored for each of the mirror surfaces 41 to 46.

Specifically, as shown in FIG. 5A, in the storage 310, respective reference surface numbers F1 to F6 as reference surface identifiers specifying the respective six mirror surfaces 41 to 46 are stored. Also, in the storage 310, writing time data which includes a reference time difference x (x1 to x6), the first writing time TY (TY1 to TY6), the second writing time TK (TK1 to TK6), the third writing time TM (TM1 to TM6) and the fourth writing time TC (TC1 to TC6) is stored for each reference surface numbers F1 to F6.

The reference surface numbers F1 to F6 are identifiers for identifying the respective mirror surfaces 41 to 46 corresponding to the writing times TY, TK, TM, TC. The writing time data is stored in the storage 310 during the manufacturing of the scanning exposure device 1.

Here, a manufacturing method of the scanning exposure device 1 is described. In the illustrative embodiment, regarding the manufacturing process of the scanning exposure device 1, a process of storing the writing time data in the storage 310 of the controller 300 is particularly described in detail. The writing time data is determined and stored from measured data that is obtained in advance when rotating the polygon mirror 40 at a constant speed.

Specifically, the manufacturing method of the illustrative embodiment mainly includes a first storing process of determining and storing the writing times TY, TK, TM, TC for each of the mirror surfaces 41 to 46 of the polygon mirror 40 in the storage 310, and a second storing process of determining and storing the reference time differences x for each of the mirror surfaces 41 to 46 in the storage 310. In the illustrative embodiment, the first storing process and the second storing process are performed substantially at the same time.

Specifically, the scanning exposure device 1 is first assembled. Then, as shown in FIG. 3, the scanning exposure device 1 is arranged at a measurement device in which respective optical sensors BDY, BDM, BDC, BDK shown with the dashed-two dotted lines are disposed at positions corresponding to the respective photosensitive members 251, instead of the photosensitive members 251. The optical sensor BDY is a sensor configured to detect the first beam BY, the optical sensor BDK is a sensor configured to detect the second beam BK, the optical sensor BDM is a sensor configured to detect the third beam BM, and the optical sensor BDC is a sensor configured to detect the fourth beam BC.

Each of the optical sensors BDY, BDK, BDM, BDC is disposed at a position corresponding to one end in the main scanning direction of a region in which an image can be formed on the sheet P. That is, the optical sensors BDY, BDK, BDM, BDC are disposed at positions at which the exposure starts as the writing times TY, TK, TM, TC elapse from the first timing T1 at which the first optical sensor BD1 detects the first beam BY.

Then, the polygon mirror 40 is rotated at the constant speed by the predetermined number of revolutions or for predetermined time. Then, when the rotation of the polygon mirror 40 is stable (for example, the polygon mirror 40 is rotated by 20 revolutions or more), following data is measured while the polygon mirror 40 rotates one revolution.

Figure 6A:
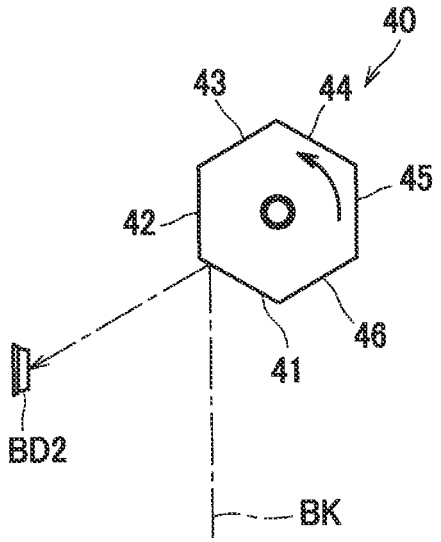
FIG. 6A depicts a state where a second beam is detected by a second optical sensor.

That is, as shown in FIG. 6A, first, when the second beam BK is reflected by the mirror surface 41 that is moved to a position at which the second beam BK is to be reflected, the second timing T2 is measured as time at which the second optical sensor BD2 detects the second beam BK.

Figure 6C:
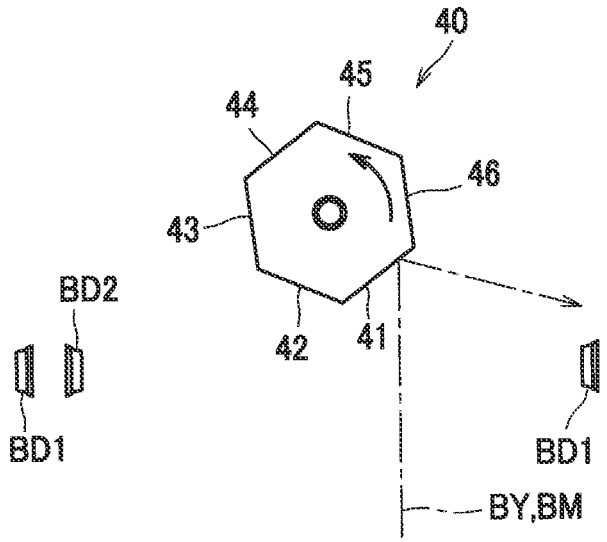
FIG. 6C depicts a state where exposure is started by the first beam.
Figure 6B:
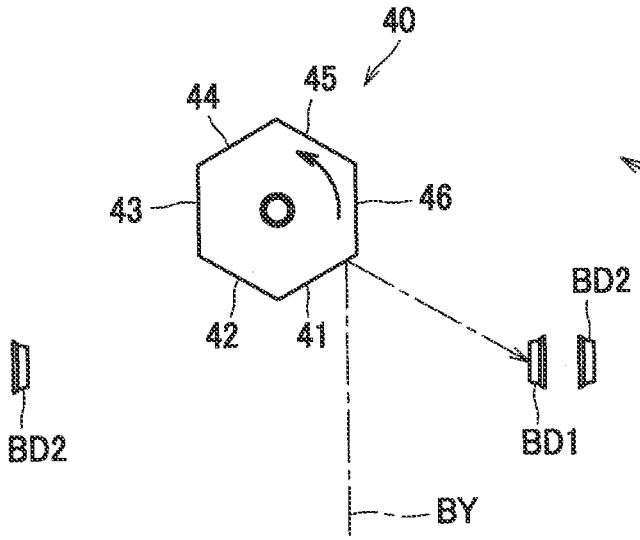
FIG. 6B depicts a state where a first beam is detected by a first optical sensor.

Then, as shown in FIG. 6B, when the first beam BY is reflected by the mirror surface 41 that is moved to a position at which the first beam BY is to be reflected, the first timing T1 is measured as time at which the first optical sensor BD1 detects the first beam BY.

Also, as shown in FIG. 6C and FIG. 3, the timing TSY is measured as time at which the optical sensor BDY detects the first beam BY reflected by the mirror surface 41, and the timing TSM is measured as time at which the optical sensor BDM detects the third beam BM reflected by the mirror surface 41.

Figure 6D:
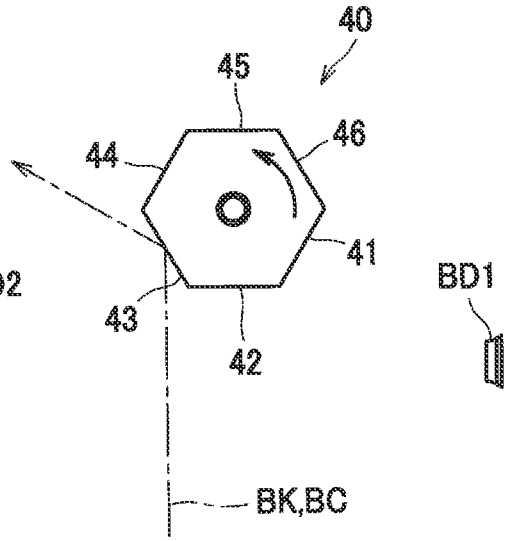
FIG. 6D depicts a state where exposure is started by the second beam.

Also, as shown in FIG. 6D and FIG. 3, the timing TSC is measured as time at which the optical sensor BDC detects the fourth beam BC reflected by the mirror surface 43 that is moved to a position, at which the beam BC, BK is to be reflected, and the timing TSK is measured as time at which the optical sensor BDK detects the second beam BK reflected by the mirror surface 43.

Here, the mirror surface 43 is a mirror surface located at a position at which the time after the first optical sensor BD1 detects the first beam BY reflected by the mirror surface 41 until the optical sensor BDK detects the second beam BK is shortest. That is, the timings TSC, TSK are measured using the mirror surface located at the position.

Then, time after the first timing T1 until the timing TSY at which the optical sensor BDY detects the first beam BY is determined as the first writing time TY1. The first writing time TY1 is time until which the first photosensitive member 251Y is started to be exposed by the first beam BY reflected by the mirror surface 41 after the first beam BY reflected by the mirror surface 41 is detected by the first optical sensor BD1.

Also, time after the first timing T1 until the timing TSK at which the optical sensor BDK detects the second beam BK is determined as the second writing time TK1. The second writing time TK1 is time at which the second photosensitive member 251K is started to be exposed by the second beam BK reflected by the mirror surface 43 after the first beam BY reflected by the mirror surface 41 is detected by the first optical sensor BD1.

Also, time after the first timing T1 until the timing TSM at which the optical sensor BDM detects the third beam BM is determined as the third writing time TM1. The third writing time TM1 is time until which the third photosensitive member 251M is started to be exposed by the third beam BM reflected by the mirror surface 41 after the first beam BY reflected by the mirror surface 41 is detected by the first optical sensor BD1.

Also, time after the first timing T1 until the timing TSC at which the optical sensor BDC detects the fourth beam BC is determined as the fourth writing time TC1. The fourth writing time TC1 is time at which the fourth photosensitive member 251C is started to be exposed by the fourth beam BC reflected by the mirror surface 43 after the first beam BY reflected by the mirror surface 41 is detected by the first optical sensor BD1.

Also, a reference time difference x1, which is a time difference between the first timing T1 and the second timing T2, is calculated and determined by subtracting the second timing T2 from the first timing T1, for example. In other words, the reference time difference x1 is time from the second timing T2, at which the second optical sensor BD2 detects the second beam BK when the second beam BK is reflected by the mirror surface 41, to the first timing T1, at which the first optical sensor BD1 detects the first beam BY when the first beam BY is reflected by the mirror surface 41.

Then, the determined writing times TY1, TK1, TM1, TC1 and reference time difference x1 are stored in the storage 310 together with the reference surface number F1, as the writing time data.

In the meantime, the time difference between the first timing T1 and the second timing T2 is set smaller than a time difference z between a timing, at which the first optical sensor BD1 detects the first beam BY reflected by the mirror surface 41 as a first reflecting surface, and a timing, at which the first optical sensor BD1 detects the first beam BY reflected by the mirror surface 42 as a second reflecting surface next to the first reflecting surface, for example, while the polygon mirror 40 rotates one revolution. That is, the reference time difference x, which is the time difference between the first timing T1 and the second timing T2, and an acquisition time difference y (which will be described later) are smaller than the time difference z.

In the manufacturing method of the illustrative embodiment, the measurement of each timing and the determination of the writing time and reference time difference are sequentially performed for the mirror surfaces 42 to 46 located upstream of the mirror surface 41 with respect to the rotating direction. In the meantime, the mirror surface for measuring the timings TSC, TSK is the mirror surface 44 with respect to the mirror surface 42, the mirror surface 45 with respect to the mirror surface 43, the mirror surface 46 with respect to the mirror surface 44, the mirror surface 41 with respect to the mirror surface 45, and the mirror surface 42 with respect to the mirror surface 46.

The writing times TY2, TK2, TM2, TC2 and the reference time difference x2 determined using the mirror surface 42 are stored in the storage 310 together with the reference surface number F2, as the writing time data. This applies to the cases where the mirror surfaces 43 to 45 are used, too. Then, the writing times TY6, TK6, TM6, TC6 and the reference time difference x6 determined using the mirror surface 46 are stored in the storage 310 together with the reference surface number F6, as the writing time data. When the storing of the writing time data is completed, the rotation of the polygon mirror 40 is stopped.

In the meantime, in the illustrative embodiment, for easy understanding, the mirror surface 41 is used as the mirror surface of the reference surface number F1. However, the mirror surface of the reference surface number F1 may be any mirror surface with which the writing times and the reference time difference are determined for the first time.

Also, the timing may be measured in a state where the scanning exposure device 1 is mounted to the main body housing 210 of the color printer 200. Also, the first storing process and the second storing process may be performed individually, not simultaneously. Also, the writing times TY, TK, TM, TC and the reference time difference x that are to be stored in the storage 310 may be average values of a plurality of reference time differences and writing times, respectively. In the meantime, in the present disclosure, the respective writing times TY, TK, TM, TC may not be time itself and may be data for determining respective the writing times.

Subsequently, processing that is to be executed by the controller 300 is described.

When controlling the scanning exposure device 1, the controller 300 mainly executes timing acquisition processing, specifying processing and exposure processing. In the illustrative embodiment, the controller 300 executes the timing acquisition processing, the specifying processing and the exposure processing in a case where a printing job including an instruction to start image formation, image data and the like is input and the image formation on the sheet P is thus started.

The timing acquisition processing is processing of rotating the polygon mirror 40 at a constant speed and acquiring the first timing T1, at which the first optical sensor BD1 detects the first beam BY, and the second timing T2, at which the second optical sensor BD2 detects the second beam BK, when the first beam BY and the second beam BK are reflected by each of the mirror surfaces 41 to 46 of the polygon mirror 40 being rotated.

Specifically, the controller 300 rotates the polygon mirror 40 at the constant speed by a predetermined number of revolutions or for predetermined time, in the timing acquisition processing. Then, when the rotation of the polygon mirror 40 is stable (for example, the polygon mirror 40 is rotated by 20 revolutions or more), the controller 300 acquires following data while the polygon mirror 40 rotates one revolution.

That is, as shown in FIG. 6A, when the second beam BK is reflected by any mirror surface that is moved to a position at which the second beam BK is to be reflected, the controller 300 acquires the second timing T2 (T21), as time at which the second optical sensor BD2 detects the second beam BK, and stores the same in the storage 310.

Also, as shown in FIG. 6B, when the first beam BY is reflected by the same mirror surface that is moved to a position at which the first beam BY is to be reflected, the controller 300 acquires the first timing T1 (T11), as time at which the first optical sensor BD1 detects the first beam BY, and stores the same in the storage 310.

Then, the controller 300 stores the acquired first timing T11 and the acquired second timing T21 in the storage 310, as the timing data as shown in FIG. 5B, together with an acquisition surface number A1 as the acquisition surface identifier.

The controller 300 sequentially performs the above processing for each of the mirror surfaces located upstream of the mirror surface with respect to the rotating direction. Then, the controller 300 stores the acquired first timing T12 and second timing T22 together with an acquisition surface number A2, stores the first timing T13 and the second timing T23 together with an acquisition surface number A3, stores the first timing T14 and the second timing T24 together with an acquisition surface number A4, stores the first timing T15 and the second timing T25 together with an acquisition surface number A5, and stores the first timing T16 and the second timing T26 together with an acquisition surface number A6.

The respective acquisition surface numbers A1 to A6 are identifiers for identifying respective mirror surfaces from which the first timing T1 and the second timing T2 are acquired in the timing acquisition processing.

In the illustrative embodiment, one set of the first timing T1 and the second timing T2 are timings acquired from the same mirror surface of the polygon mirror 40. Specifically, one set of the first timing T1 and the second timing T2 are the timing, at which the first optical sensor BD1 detects the first beam BY, and the timing, at which the second optical sensor BD2 detects the second beam BK, the first beam and the second beam being reflected by a mirror surface specified by the same reference surface identifier.

In the specifying processing, the controller 300 specifies a correspondence relation between the respective reference surface identifiers and the respective acquisition surface identifiers, based on the first timing T1 and the second timing T2 acquired in the timing acquisition processing. Specifically, in the specifying processing, the controller 300 specifies to which of the reference surface numbers F1 to F6 the mirror surfaces of the acquisition surface numbers A1 to A6 correspond, based on an acquisition time difference y, which is the time difference between the first timing T1 and the second timing T2. More specifically, the controller 300 specifies the correspondence relation based on a correlation coefficient r between the reference time difference x and the acquisition time difference y.

Specifically, the controller 300 calculates the acquisition time difference y for each of the mirror surfaces (the acquisition surface numbers A1 to A6). In the illustrative embodiment, the acquisition time difference y (y1 to y6) is calculated as a value obtained by subtracting the second timing T2 (T21 to T26) from the first timing T1 (T11 to T16), for example, and is stored in the storage 310, as the acquisition time difference data as shown in FIG. 5C, together with the acquisition surface numbers A1 to A6.

In the meantime, the controller 300 may be configured to acquire a plurality of sets of the first timing T1 and the second timing T2 for each of the mirror surfaces in the timing acquisition processing, calculate a time difference for each set of the first timing T1 and the second timing T2, and store an average value of the plurality of calculated time differences, as the acquisition time difference y, in the specifying processing.

Then, as shown in FIG. 7A, the controller 300 generates and stores a first correspondence pattern in the storage 310. In the first correspondence pattern, the reference time difference stored for each of the reference surface numbers F1 to F6 and the time difference between the first timing and the second timing acquired for each of the acquisition surface numbers A1 to A6 are associated with each other. For example, in the first correspondence pattern, the acquisition surface number A1 is associated with the reference surface number F1, the acquisition surface number A2 is associated with the reference surface number F2, the acquisition surface number A3 is associated with the reference surface number F3, the acquisition surface number A4 is associated with the reference surface number F4, the acquisition surface number A5 is associated with the reference surface number F5 and the acquisition surface number A6 is associated with associates the reference surface number F6. The first correspondence pattern corresponds to "one correspondence pattern".

Then, the controller 300 calculates a first correlation coefficient r1, which is the correlation coefficient r in a case where the reference time difference stored for each of the reference surface numbers F1 to F6 and the time difference between the first timing and the second timing acquired for each of the acquisition surface numbers A1 to A6 are associated with each other in the first correspondence pattern, and stores the same in the storage 310.

The correlation coefficient r can be calculated by a following equation where the average value of the reference time differences x1 to x6 is denoted as $x_{ave}$ and the average value of the acquisition time differences y1 to y6 is denoted as $y_{ave}$, for example.

$$r=\Sigma(x-x_{ave})(y-y_{ave})/(\Sigma(x-x_{ave})^2\cdot\Sigma(y-y_{ave})^2)^{1/2}$$

In the meantime, the numerical values of the reference time difference x, the acquisition time difference y and the correlation coefficient r shown in FIG. 7 are all exemplary.

Then, as shown in FIG. 7B, the controller 300 generates and stores a second correspondence pattern in the storage 310. In the second correspondence pattern, the correspondence relation between the respective reference surface numbers F1 to F6 and the respective acquisition surface numbers A1 to A6 is associated in the second correspondence pattern in which each of the acquisition surface numbers A1 to A6 is deviated from the first correspondence pattern by 1. For example, in the second correspondence pattern, the acquisition surface number A1 is associated with the reference surface number F2, the acquisition surface number A2 is associated with the reference surface number F3, the acquisition surface number A3 is associated with the reference surface number F4, the acquisition surface number A4 is associated with the reference surface number F5, the acquisition surface number A5 is associated with the reference surface number F6 and the acquisition surface number A6 is associated with the reference surface number F1.

Then, the controller 300 calculates a second correlation coefficient r2, which is the correlation coefficient r in a case where the respective reference surface numbers F1 to F6 and the respective acquisition surface numbers A1 to A6 are associated in the second correspondence pattern, and stores the same in the storage 310.

Similarly, as shown in FIG. 7C, the controller 300 generates a third correspondence pattern. In the third correspondence pattern, each of the acquisition surface numbers A1 to A6 is deviated from the first correspondence pattern by 2, and calculates and stores a third correlation coefficient r3, which is the correlation coefficient r in the corresponding case. Also, as shown in FIG. 7D, the controller 300 generates a fourth correspondence pattern. In the fourth correspondence pattern, each of the acquisition surface numbers A1 to A6 is deviated from the first correspondence pattern by 3, and calculates and stores a fourth correlation coefficient r4, which is the correlation coefficient r in the corresponding case. Also, as shown in FIG. 7E, the controller 300 generates a fifth correspondence pattern. In the fifth correspondence pattern, each of the acquisition surface numbers A1 to A6 is deviated from the first correspondence pattern by 4, and calculates and stores a fifth correlation coefficient r5, which is the correlation coefficient r in the corresponding case.

Then, as shown in FIG. 7F, the controller 300 calculates and stores a sixth correlation coefficient r6, which is the correlation coefficient in a case where the correspondence relation between the respective reference surface numbers F1 to F6 and the respective acquisition surface numbers A1 to A6 is associated in a correspondence pattern in which each of the acquisition surface numbers A1 to A6 is deviated from the first correspondence pattern by 5. In the illustrative embodiment, the sixth correlation coefficient corresponds to "$N^{th}$ correlation coefficient".

After calculating the first correlation coefficient r1 to the sixth correlation coefficient r6, the controller 300 specifies the correspondence relation between the mirror surfaces of the respective reference surface numbers F1 to F6 and the mirror surfaces 41 to 46 of the respective acquisition surface numbers A1 to A6 by selecting the correspondence pattern in which the correlation coefficient r is closest to 1 of the first correlation coefficient r1 to the sixth correlation coefficient r6.

For example, the controller 300 selects the sixth correspondence pattern corresponding to the sixth correlation coefficient r6, which is closest to 1, and as shown in FIG. 5D, specifies the mirror surface of the acquisition surface number A2 as the mirror surface 41 of the reference surface number F1, specifies the mirror surface of the acquisition surface number A3 as the mirror surface 42 of the reference surface number F2, specifies the mirror surface of the acquisition surface number A4 as the mirror surface 43 of the reference surface number F3, specifies the mirror surface of the acquisition surface number A5 as the mirror surface 44 of the reference surface number F4, specifies the mirror surface of the acquisition surface number A6 as the mirror surface 45 of the reference surface number F5, and specifies the mirror surface of the acquisition surface number A1 as the mirror surface 46 of the reference surface number F6, and stores the same in the storage 310, as the surface specifying data.

In the meantime, when the first correlation coefficient r1 to the sixth correlation coefficient r6 are all smaller than 0.7, the controller 300 sets the first writing time TY to be the same for all the mirror surfaces 41 to 46, sets the second writing time TK to be the same for all the mirror surfaces 41 to 46, sets the third writing time TM to be the same for all the mirror surfaces 41 to 46, and sets the fourth writing time TC to be the same for all the mirror surfaces 41 to 46. For example, when the first correlation coefficient r1 to the sixth correlation coefficient r6 are all smaller than 0.7, the controller 300 sets the first writing time TY to an average value of the writing times TY1 to TY6, sets the second writing time TK to an average value of the writing times TK1 to TK6, sets the third writing time TM to an average value of the writing times TM1 to TM6, and sets the fourth writing time TC to an average value of the writing times TC1 to TC6 for all the mirror surfaces 41 to 46, and stores the same in the storage 310.

In the exposure processing, the respective photosensitive members 251 are exposed by the respective beams BY, BK, BM, BC emitted from the respective light source devices 20 based on the correspondence between the respective mirror surfaces 41 to 46 and the respective writing times TY, TK, TM, TC, which is specified in the specifying processing, when forming an image on the sheet P.

Specifically, in the exposure processing, the controller 300 replaces the acquisition surface numbers A1 to A6 with the reference surface numbers F1 to F6 based on the surface specifying data shown in FIG. 5D, determines the writing times TY, TK, TM, TC for each of the mirror surfaces 41 to 46 based on the writing time data shown in FIG. 5A, and exposes the respective photosensitive members 251.

For example, in a case where the mirror surface 41 (the mirror surface that had the acquisition surface number A2) is used, the controller 300 starts to expose the first photosensitive member 251Y by the first beam BY, which is reflected by the mirror surface 41, as shown in FIG. 6C, after the first writing time TY1 until the detection timing TS at which the first optical sensor BD1 detects the first beam BY reflected by the mirror surface 41 (refer to FIG. 6B). Also, the controller 300 starts to expose the third photosensitive member 251M by the third beam BM that is reflected by the mirror surface 41 after the third writing time TM1 until the detection timing TS.

Also, the controller 300 starts to expose the second photosensitive member 251K by the second beam BK, which is reflected by the mirror surface 43, as shown in FIG. 6D, after the second writing time TK1 until the detection timing TS, and starts to expose the fourth photosensitive member 251C by the fourth beam BC that is reflected by the mirror surface 43 after the fourth writing time TC1 until the detection timing TS.

Similarly, in a case where the mirror surface 42 (the mirror surface that had the acquisition surface number A3) is used, the controller 300 starts to expose the first photosensitive member 251Y by the first beam BY, which is reflected by the mirror surface 42 after the first writing time TY2 until the detection timing TS at which the first optical sensor BD1 detects the first beam BY reflected by the mirror surface 42. Also, on the basis of the detection timing TS, the controller 300 starts to expose the third photosensitive member 251M by the third beam BM that is reflected by the mirror surface 42 after the third writing time TM2, starts to expose the second photosensitive member 251K by the second beam BK that is reflected by the mirror surface 44 after the second writing time TK2, and starts to expose the fourth photosensitive member 251C by the fourth beam BC that is reflected by the mirror surface 44 after the fourth writing time TC2.

The above applies to a case where the mirror surface 43 (the mirror surface that had the acquisition surface number A4) is used, a case where the mirror surface 44 (the mirror surface that had the acquisition surface number A5) is used, a case where the mirror surface 45 (the mirror surface of the acquisition surface number A6) is used, and a case where the mirror surface 46 (the mirror surface that had the acquisition surface number A1) is used.

Subsequently, operations of the controller 300 (a control method of the scanning exposure device 1) are described.

Figure 8:
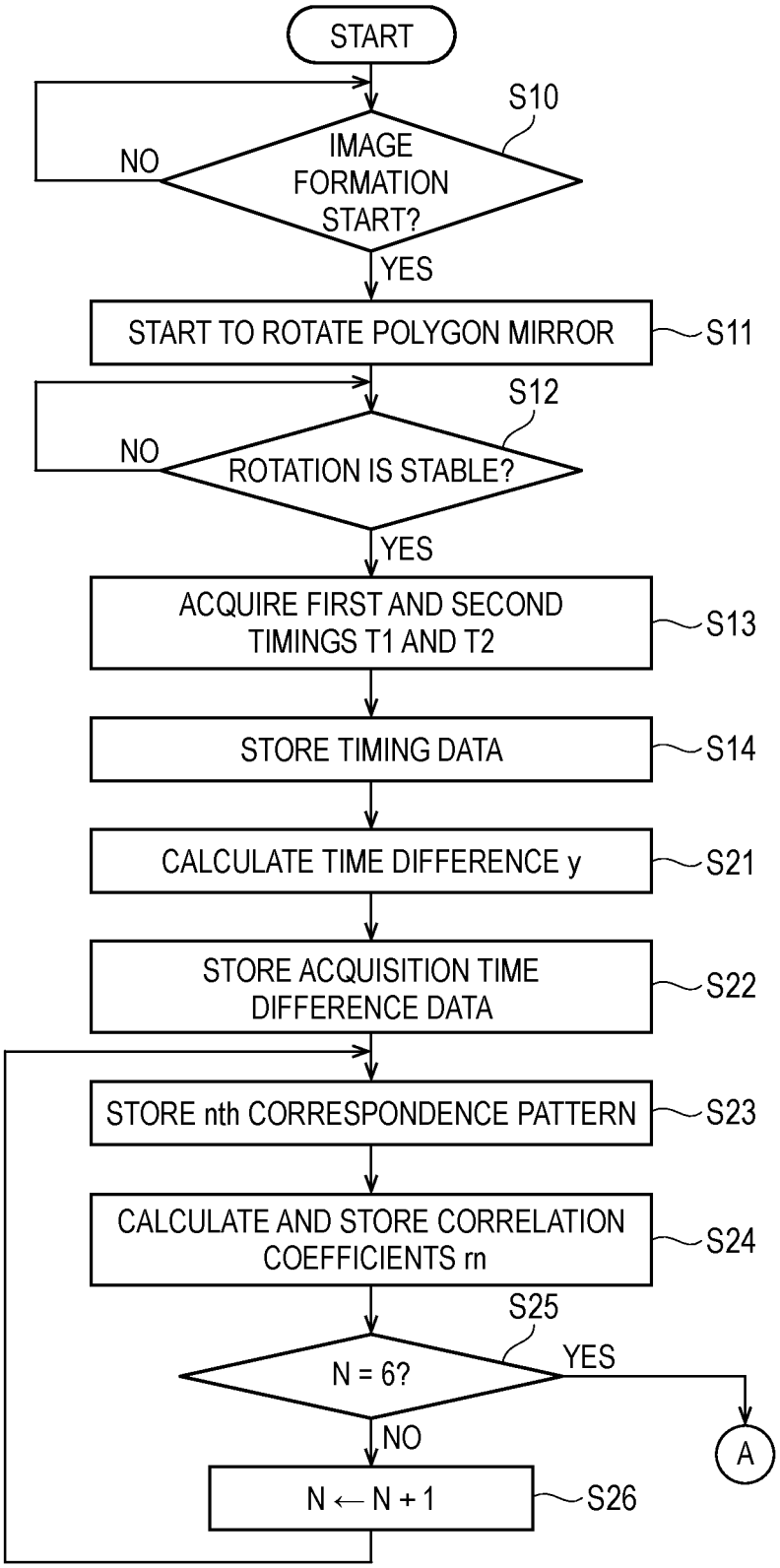
FIG. 8 is a flowchart depicting operations of a controller.

As shown in FIG. 8, in a case where a printing job is input to the controller 300 and the image formation on the sheet P is started (S10, Yes), the controller 300 first executes the timing acquisition processing.

Specifically, the controller 300 first rotates the polygon mirror 40 at a constant speed (S11). Then, when the polygon mirror 40 is rotated by the predetermined number of revolutions or for the predetermined time and the rotation of the polygon mirror 40 is thus stable (S12, Yes), the controller 300 acquires the first timing T1 (T11 to T16) and the second timing T2 (T21 to T26) for each mirror surface of the polygon mirror 40 (S13). Then, the controller 300 stores the acquired timings T11 to T16 and T21 to T26 in the storage 310, as the timing data (refer to FIG. 5B), together with the acquisition surface numbers A1 to A6 (S14).

Then, the controller 300 executes the specifying processing. Specifically, the controller 300 calculates the acquisition time difference y (y1 to y6) for each of the mirror surfaces from the timing data (S21), the respective mirror surfaces being identified by the respective acquisition surface numbers A1 to A6. The controller 300 stores the calculated acquisition time differences y1 to y6 in the storage 310, as the acquisition time difference data (refer to FIG. 5C), together with the acquisition surface numbers A1 to A6 (S22).

Then, the controller 300 generates and stores the first correspondence pattern (refer to FIG. 7A) in the storage 310 (S23), and calculates and stores the first correlation coefficient r1, which is associated in the first correspondence pattern, in the storage 310 (S24). In the meantime, the initial value of N is 1.

Then, the controller 300 determines whether N is 6 (maximum value) (S25). When N is not 6 (S25, No), the controller 300 adds 1 to N (S26) and returns to step S23. Thereafter, the controller 300 generates and stores the second correspondence pattern to the sixth correspondence pattern (refer to FIGS. 7B to 7F) in the storage 310 (S23), and calculates and stores the second correlation coefficient r2 to the sixth correlation coefficient r6, which correspond to the second correspondence pattern to the sixth correspondence pattern, respectively, in the storage 310 (S24).

Figure 9:
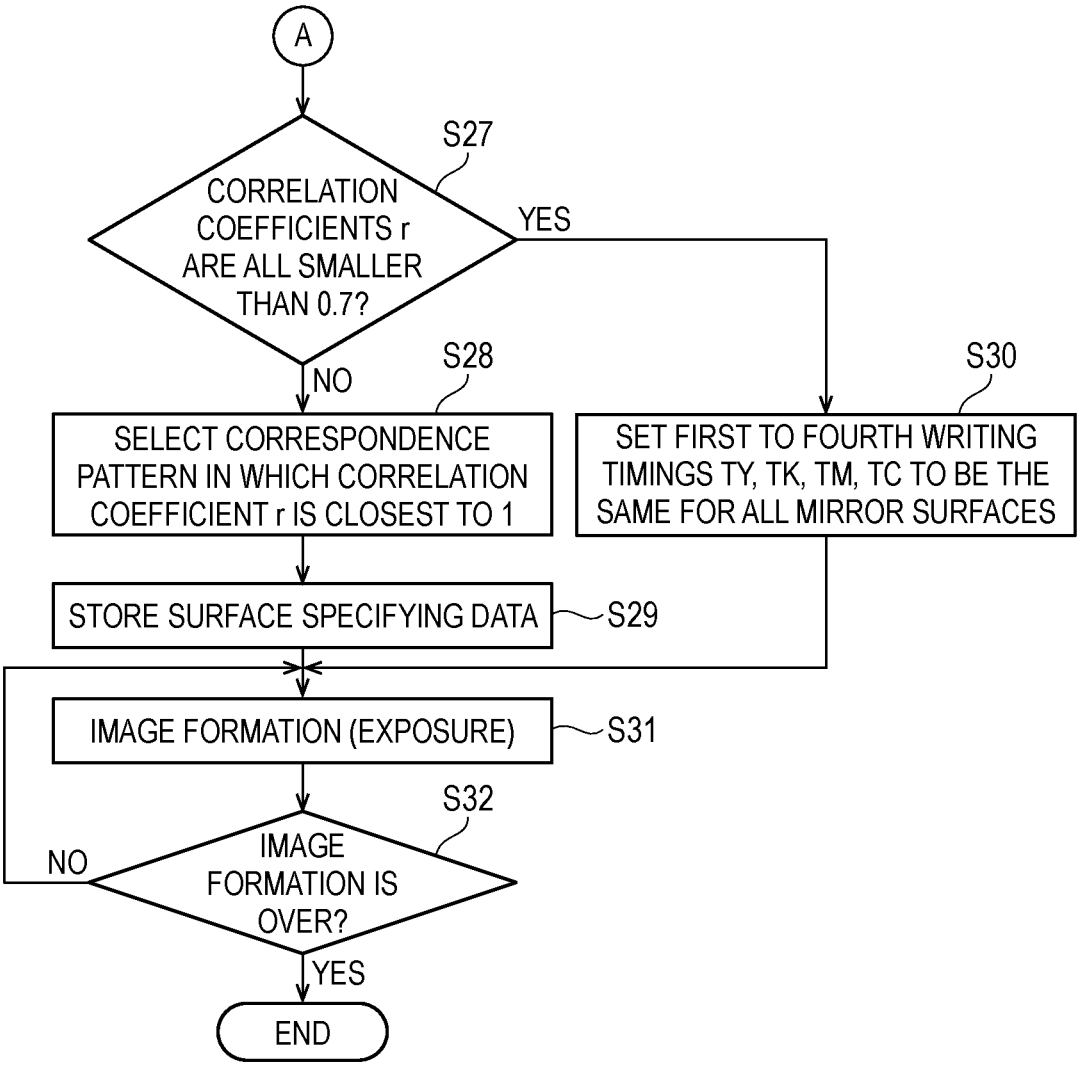
FIG. 9 is a flowchart depicting the operations of the controller.

In step S25, when N is 6 (S25, Yes), as shown in FIG. 9, the controller 300 determines whether the correlation coefficients r1 to r6 are all smaller than 0.7 (S27). When all the correlation coefficients r1 to r6 are not smaller than 0.7 (S27, No), the controller 300 selects the correspondence pattern, in which the correlation coefficient r is closest to 1 (S28), stores the surface specifying data (refer to FIG. 5D), in which the mirror surface of the acquisition surface number A1 is specified as the mirror surface 41 to 46 of the corresponding reference surface number F1 to F6, in the storage 310 (S29).

On the other hand, in step S27, in a case where the correlation coefficients r1 to r6 are all smaller than 0.7 (S27, Yes), the controller 300 sets the first writing time TY to be the same, the second writing time TK to be the same, the third writing time TM to be the same and the fourth writing time TC to be the same for all the mirror surfaces 41 to 46 (S30).

Thereafter, the controller 300 forms an image on the sheet P (S31). At this time, the controller 300 determines the writing times TY, TK, TM, TC for each of the mirror surfaces 41 to 46, based on the surface specifying data (refer to FIG. 5D) and the writing time data (refer to FIG. 5A), and executes the exposure processing of exposing the respective photosensitive members 251 by the respective beams BY, BK, BM, BC emitted from the respective light source devices 20. Then, when the image formation on the sheet P is over (S32, Yes), the controller 300 ends the series of operations.

As described above, according to the illustrative embodiment, it is possible to accomplish following effects.

Since the correspondence relation between the respective reference surface identifiers and the respective acquisition surface identifiers are specified based on the first timing T1 at which the first optical sensor BD1 detects the first beam BY and the second timing T2 at which the second optical sensor BD2 detects the second beam BK, it is possible to accurately specify the mirror surfaces 41 to 46. Thereby, it is possible to accurately set the writing time TK of the second beam BK that is not detected by the first optical sensor BD1 as well as the first beam BY of which the writing timing is detected by the first optical sensor BD1, for each of the mirror surfaces 41 to 46. As a result, it is possible to improve the accuracy of the writing positions of the first beam BY and the second beam BK on the photosensitive members 251Y, 251K, thereby performing the high-accuracy exposure.

Also, in the illustrative embodiment, since it is possible to accurately set the writing times of the third beam BM and the fourth beam BC as well as the first beam BY and the second beam BK, for each of the mirror surfaces 41 to 46, it is possible to improve the accuracy of the writing positions of all the beams BY, BK, BM, BC on the respective photosensitive members 251.

Also, since the first timing T1 and the second timing T2 for calculating the acquisition time difference y, which is to be used to specify the surface, are timings at which the beams are reflected by a mirror surface specified by the same reference identifier, it is possible to specify the mirror surfaces 41 to 46 without an influence of a difference of the surface accuracy of each of the mirror surfaces 41 to 46, and the like. Thereby, it is possible to specify the mirror surfaces 41 to 46 with higher accuracy.

Also, since the acquisition time difference y and the reference time difference x are shorter than the time difference z between the timing at which the first optical sensor BD1 detects the first beam BY reflected by the mirror surface 41 and the timing at which the first optical sensor BD1 detects the first beam BY reflected by the mirror surface 42, for example, it is possible to suppress an influence of unevenness of rotation of the motor of the polygon mirror 40. Thereby, it is possible to specify the mirror surfaces 41 to 46 with higher accuracy.

Also, since the correspondence relation between the respective reference surface identifiers and the respective acquisition surface identifiers based on the correlation coefficient r between the reference time difference x and the acquisition time difference y, it is possible to perform the high-accuracy matching and to specify the mirror surfaces 41 to 46 with higher accuracy. Also, the correlation coefficient r is used, so that it is possible to specify the mirror surfaces 41 to 46 even though a rotating speed of the polygon mirror 40 in the second storing process when determining the reference time difference x and a rotating speed of the polygon mirror 40 in the timing acquisition processing are different.

Also, since the first scanning optical system SC1 and the second scanning optical system SC2 are disposed at opposite sides with the polygon mirror 40 being interposed therebetween, as seen from the rotation axis direction, it is possible to dispose the first optical sensor BD1 and the second optical sensor BD2 at opposite sides with the polygon mirror 40 being interposed therebetween, as seen from the rotation axis direction. Thereby, since it is possible to reflect an influence of the axis tilting of the polygon mirror 40 when specifying the mirror surfaces 41 to 46, it is possible to specify the mirror surfaces 41 to 46 with higher accuracy.

Also, since the first optical sensor BD1 is disposed upstream with respect to the scanning direction of the first beam BY and the second optical sensor BD2 is disposed downstream with respect to the scanning direction of the second beam BK, it is possible to differently set the position at which the first beam BY is to be reflected and the position at which the second beam BK is to be reflected, by each of the mirror surfaces 41 to 46. Specifically, as shown in FIG. 2, the position of each of the mirror surfaces 41 to 46 at which the first beam BY is to be reflected may be set to the front position, and the position of each of the mirror surfaces 41 to 46 at which the second beam BK is to be reflected may be set to the rear position. Thereby, it is possible to reflect the influences of surface accuracy, surface tilting and the like when specifying the mirror surfaces 41 to 46, so that it is possible to specify the mirror surfaces 41 to 46 with higher accuracy.

Also, according to the manufacturing method of the illustrative embodiment, it is possible to accurately determine the writing times TY, TK, TM, TC and to accurately set the reference time difference x by using the dedicated equipment, such as the measurement device including the optical sensors BDY, BDM, BDC, BDK. Thereby, since it is possible to specify the mirror surfaces 41 to 46 with higher accuracy, it is possible to perform the higher-accuracy exposure.

Although the illustrative embodiment of the present disclosure has been described, the present disclosure is not limited to the illustrative embodiment. The specific configuration can be appropriately changed without departing from the spirit of the present disclosure, as follows.

For example, the light source devices 20 (20Y, 20M, 20C, 20K) may include a plurality of light-emitting points and may be configured to emit a plurality of beams, respectively. As an example, each light source device 20 may include a laser array for emitting a plurality of laser lights, instead of the semiconductor laser LD. In this case, in the storage 310 of the controller 300, the data of the writing times TY, TK, TM, TC is stored for each of the plurality of light-emitting points. The controller 300 may be configured to start the exposure by the corresponding beam after each writing time until the detection timing at which the first optical sensor BD1 is to detect the first beam, in the exposure processing.

Specifically, when the light source device 20 has two light-emitting points, for example, the controller 300 stores the writing time data, which includes the writing times TY, TK, TM, TC for each of beams BY1, BY2, BK1, BK2, BM1, BM2, BC1, BC2, as shown in FIG. 10.

In the above configuration, the controller 300 acquires the first timing T1 at which the first optical sensor BD1 detects the preceding first beam BY1 and the second timing T2 at which the second optical sensor BD2 detects the preceding second beam BK1, in the timing acquisition processing. Then, the controller 300 specifies each of the mirror surfaces 41 to 46 of the polygon mirror 40 corresponding to the writing times TY, TK, TM, TC, based on the timings T1, T2, in the specifying processing, like the above illustrative embodiment.

Thereafter, the controller 300 starts to expose the photosensitive member 251 by the first beam BY1 after the first writing time TYn1 from the detection timing TS at which the first optical sensor BD1 detects the preceding first beam BY1 and starts to expose the photosensitive member 251 by the first beam BY2 after the first writing time TYn2 from the detection timing TS, in the exposure processing.

Also, the controller 300 starts to expose the photosensitive member 251 by the second beam BK1 after the second writing time TKn1, and starts to expose the photosensitive member 251 by the second beam BK2 after the second writing time TKn2, on the basis of the detection timing TS. Also, the controller 300 starts to expose the photosensitive member 251 by the third beam BM1 after the third writing time TMn1, and starts to expose the photosensitive member 251 by the third beam BM2 after the third writing time TMn2. Also, the controller 300 starts to expose the photosensitive member 251 by the fourth beam BC1 after the fourth writing time TCn1, and starts to expose the photosensitive member 251 by the fourth beam BC2 after the fourth writing time TCn2.

According to the above configuration, since it is possible to accurately set the writing times TY, TK, TM, TC of each beam to be emitted from each light-emitting point, it is possible to improve the accuracy of the writing position of each beam on the photosensitive member 251. Thereby, it is possible to perform the high-accuracy exposure.

Also, in the above illustrative embodiment, when generating the second correspondence pattern to the sixth correspondence pattern in the specifying processing, the acquisition surface numbers A1 to A6 are deviated from the reference surface numbers F1 to F6 of the first correspondence pattern. However, the present disclosure is not limited thereto. For example, the reference surface numbers may be deviated from the acquisition surface numbers of the first correspondence pattern when generating the second correspondence pattern to the sixth correspondence pattern.

Also, in the above illustrative embodiment, in the second storing process of the manufacturing process of the scanning exposure device 1, the reference time difference x is determined and stored in the storage 310 of the controller 300. However, the present disclosure is not limited thereto. For example, the second storing process may be a process of storing the timing, at which the first optical sensor detects the first beam, and the timing, at which the second optical sensor detects the second beam, in the storage, the timings being stored for each reflecting surface of the polygon mirror. That is, the second storing process may be a process of storing a timing for calculating the reference time difference, which is measured using the dedicated equipment, in the storage. In this case, the reference time difference may be calculated and used from the stored timings in the specifying processing or the like by the controller.

Also, in the above illustrative embodiment, the first timing T1 and the second timing T2 are timings at which the beams reflected by the mirror surface of the polygon mirror 40 specified by the same reference surface identifier are detected. However, the present disclosure is not limited thereto. For example, the first timing and the second timing may be timings at which the beams reflected by the mirror surfaces of the polygon mirror 40 specified by the different reference surface identifiers are detected.

Also, in the above illustrative embodiment, the hexagonal polygon mirror 40 having the six reflecting surfaces (the mirror surfaces 41 to 46) has been exemplified. However, the present disclosure is not limited thereto. For example, the number of the reflecting surfaces is not limited to six. For example, the polygon mirror may be a quadrangular polygon mirror having four reflecting surfaces or an octagonal polygon mirror having eight reflecting surfaces.

Also, the configuration of the scanning optical systems SC1 to SC4 described in the illustrative embodiment is exemplary and the present disclosure is not limited to the configuration of the illustrative embodiment. For example, the scanning optical system may be different from the illustrative embodiment, in terms of the numbers, arrangements of the lenses and the reflectors.

Also, in the above illustrative embodiment, the photosensitive drum has been exemplified as the photosensitive member. However, the present disclosure is not limited thereto. For example, the photosensitive member may be a belt-type photosensitive member or the like.

Also, in the above illustrative embodiment, the controller 300 is provided in the main body housing 210 of the color printer 200. However, the present disclosure is not limited thereto. For example, the controller may be provided in the casing of the scanning exposure device.

Also, in the above illustrative embodiment, the scanning exposure device 1 is provided in the color printer 200. However, the present disclosure is not limited thereto. For example, the scanning exposure device may be provided to the other image forming apparatuses such as a copier, a complex machine and the like.

Also, the respective elements described in the illustrative embodiment and the modified embodiments can be implemented with being appropriately combined.

What is claimed is:

1. A scanning exposure device comprising:

a first light source configured to emit a first beam;

a second light source configured to emit a second beam;

a polygon mirror having N reflecting surfaces for reflecting the first beam and the second beam;

a first scanning optical system configured to focus the first beam, which is reflected by the polygon mirror, on a first image surface;

a second scanning optical system configured to focus the second beam, which is reflected by the polygon mirror, on a second image surface;

a first optical sensor configured to detect the first beam reflected by the polygon mirror;

a second optical sensor configured to detect the second beam reflected by the polygon mirror; and a controller storing reference surface identifiers that respectively specify the reflecting surfaces of the polygon mirror and storing first writing time, which is a time until which the first image surface is started to be exposed by the first beam after the first beam is detected by the first optical sensor, and second writing time, which is a time until which the second image surface is started to be exposed by the second beam after the first beam is detected by the first optical sensor, for each of the reference surface identifiers, wherein the controller is configured to:

acquire a first timing at which the first optical sensor detects the first beam and a second timing at which the second optical sensor detects the second beam for each of the reflecting surfaces when the polygon mirror is rotated at a constant speed and the first beam and the second beam are reflected by each of the reflecting surfaces, the respective reflecting surfaces being identified by respective acquisition surface identifiers; and specify a correspondence relation between the respective reference surface identifiers and the respective acquisition surface identifiers based on the first timing and the second timing by selecting a correspondence pattern among N correspondence patterns from a first correspondence pattern to a $N^{th}$ correspondence pattern, the first correspondence pattern being one correspondence pattern in which the respective reference surface identifiers and the respective acquisition surface identifiers are associated, and each of a second correspondence pattern to the $N^{th}$ correspondence pattern of the N correspondence patterns being a correspondence pattern in which each of the reference surface identifiers or each of the acquisition surface identifiers is deviated from the one correspondence pattern by 1 to N−1.

2. The scanning exposure device according to claim 1, wherein the controller is configured to specify the correspondence relation between the respective reference surface identifiers and the respective acquisition surface identifiers based on a time difference between the first timing and the second timing.

3. The scanning exposure device according to claim 2, wherein the first timing is a timing at which the first beam is detected and the second timing at which the second beam is detected, the first beam and the second beam being reflected by a reflecting surface of the polygon mirror specified by the same reference surface identifier.

4. The scanning exposure device according to claim 2 wherein the time difference between the first timing and the second timing is smaller than a time difference between a timing at which the first optical sensor detects the first beam reflected by a first reflecting surface of the polygon mirror and a timing at which the first optical sensor detects the first beam reflected by a second reflecting surface of the polygon mirror next to the first reflecting surface.

5. The scanning exposure device according to claim 1, wherein when specifying the correspondence relation, the controller is configured to calculate:

a first correlation coefficient, which is the correlation coefficient in a case where the reference time difference stored for each of the reference surface identifiers and the time difference between the first timing and the second timing acquired for each of the acquisition surface identifiers are associated with each other in the one correspondence pattern; and a second correlation coefficient to a $N^{th}$ correlation coefficient, each of which is the correlation coefficient in a case where the correspondence relation between the respective reference surface identifiers and the respective acquisition surface identifiers is associated in a correspondence pattern in which each of the reference surface identifiers or each of the acquisition surface identifiers is deviated from the one correspondence pattern by 1 to N−1, and the controller is configured to specify the correspondence relation between the respective reference surface identifiers and the respective acquisition surface identifiers by selecting a correspondence pattern in which a correlation coefficient is closest to 1 of the first correlation coefficient to the $N^{th}$ correlation coefficient.

6. The scanning exposure device according to claim 5, wherein in a case where the first correlation coefficient to the $N^{th}$ correlation coefficient are all smaller than 0.7 when specifying the correspondence relation, the controller sets the first writing time to be the same for all the reflecting surfaces and sets the second writing time to be the same for all the reflecting surfaces.

7. The scanning exposure device according to claim 1, wherein the first scanning optical system and the second scanning optical system are disposed at opposite sides with the polygon mirror being interposed therebetween, as seen from a rotation axis direction of the polygon mirror.

8. The scanning exposure device according to claim 1, further comprising:

a third light source configured to emit a third beam, and a third scanning optical system configured to focus the third beam, which is reflected by the polygon mirror, on a third image surface, wherein the controller further stores third writing time, which is time until which the third image surface is started to be exposed by the third beam after the first beam is detected by the first optical sensor, for each of the reference surface identifiers.

9. The scanning exposure device according to claim 1, wherein the first optical sensor is disposed at a more upstream side with respect to a scanning direction than a range in which the first beam is to be scanned so as to expose the first image surface, and wherein the second optical sensor is disposed at a more downstream side with respect to the scanning direction than a range in which the second beam is to be scanned so as to expose the second image surface.

10. The scanning exposure device according to claim 1, wherein the first light source has a plurality of light-emitting points and the second light source has a plurality of light-emitting points, and wherein the controller stores the first writing time for each first beam emitted from the plurality of light-emitting points of the first light source and the second writing time for each second beam emitted from the plurality of light-emitting points of the second light source.

11. A control method of a scanning exposure device, the scanning exposure device comprising:

a first light source configured to emit a first beam;

a second light source configured to emit a second beam;

a polygon mirror having N reflecting surfaces for reflecting the first beam and the second beam;

a first scanning optical system configured to focus the first beam, which is reflected by the polygon mirror, on a first image surface;

a second scanning optical system configured to focus the second beam, which is reflected by the polygon mirror, on a second image surface;

a first optical sensor configured to detect the first beam reflected by the polygon mirror;

a second optical sensor configured to detect the second beam reflected by the polygon mirror; and a storage in which reference surface identifiers that respectively specify the reflecting surfaces of the polygon mirror are stored, and in which first writing time, which is time until which the first image surface is started to be exposed by the first beam after the first beam is detected by the first optical sensor, and second writing time, which is time until which the second image surface is started to be exposed by the second beam after the first beam is detected by the first optical sensor, are stored for each of the reference surface identifiers, wherein the control method comprises:

acquiring a first timing, at which the first optical sensor detects the first beam, and a second timing, at which the second optical sensor detects the second beam, when the polygon mirror is rotated at a constant speed and the first beam and the second beam are reflected by each of the reflecting surfaces of the polygon mirror, the respective reflecting surfaces being identified by respective acquisition surface identifiers; and specifying a correspondence relation between the respective reference surface identifiers and the respective acquisition surface identifiers based on the first timing and the second timing by selecting a correspondence pattern among N correspondence patterns from a first correspondence pattern to a $N^{th}$ correspondence pattern, the first correspondence pattern being one correspondence pattern in which the respective reference surface identifiers and the respective acquisition surface identifiers are associated, and each of a second correspondence pattern to the $N^{th}$ correspondence pattern of the N correspondence patterns being a correspondence pattern in which each of the reference surface identifiers or each of the acquisition surface identifiers is deviated from the one correspondence pattern by 1 to N−1.

12. A scanning exposure device comprising:

a first light source configured to emit a first beam;

a second light source configured to emit a second beam;

a polygon mirror having N reflecting surfaces for reflecting the first beam and the second beam;

a first scanning optical system configured to focus the first beam, which is reflected by the polygon mirror, on a first image surface;

a second scanning optical system configured to focus the second beam, which is reflected by the polygon mirror, on a second image surface;

a first optical sensor configured to detect the first beam reflected by the polygon mirror;

a second optical sensor configured to detect the second beam reflected by the polygon mirror; and a controller having a storage storing:

reference surface identifiers that respectively specify the reflecting surfaces of the polygon mirror;

first writing time, which is time until which the first image surface is started to be exposed by the first beam after the first beam is detected by the first optical sensor, for each of the reference surface identifiers;

second writing time, which is time until which the second image surface is started to be exposed by the second beam after the first beam is detected by the first optical sensor, for each of the reference surface identifiers; and a reference time difference between a timing at which the first optical sensor detects the first beam and a timing at which the second optical sensor detects the second beam for each of the reference surface identifiers, wherein the first writing time, the second writing time, and the reference time difference are stored in the storage for each of the reference surface identifiers during manufacturing of the scanning exposure device, and wherein the controller is configured to:

acquire an acquisition time difference between a first timing at which the first optical sensor detects the first beam and a second timing at which the second optical sensor detects the second beam for each of the reflecting surfaces when the polygon mirror is rotated at a constant speed and the first beam and the second beam are reflected by each of the reflecting surfaces, the respective reflecting surfaces being identified by respective acquisition surface identifiers; and specify a correspondence relation between the respective reference surface identifiers and the respective acquisition surface identifiers based on a comparison between the reference time difference and the acquisition time difference.

13. A scanning exposure device according to claim 12, wherein the controller is configured to specify the correspondence relation between the respective reference surface identifiers and the respective acquisition surface identifiers based on the comparison between the reference time difference and the acquisition time difference by selecting a correspondence pattern among N correspondence patterns from a first correspondence pattern to a $N^{th}$ correspondence pattern, the first correspondence pattern being one correspondence pattern in which the respective reference surface identifiers and the respective acquisition surface identifiers are associated, and each of a second correspondence pattern to the $N^{th}$ correspondence pattern of the N correspondence patterns being a correspondence pattern in which each of the reference surface identifiers or each of the acquisition surface identifiers is deviated from the one correspondence pattern by 1 to N−1.

* * * * *